US006453833B1

(12) United States Patent
Ozeki

(10) Patent No.: US 6,453,833 B1
(45) Date of Patent: Sep. 24, 2002

(54) HEADGEAR FRAME FOR EMBROIDERING MACHINE

(75) Inventor: Masahiko Ozeki, Aichi-ken (JP)

(73) Assignee: Kabushikikaisha Barudan, Aichi-ken (JP)

( * ) Notice: Subject to any disclaimer, the term of this patent is extended or adjusted under 35 U.S.C. 154(b) by 0 days.

(21) Appl. No.: 09/962,846

(22) Filed: Sep. 26, 2001

(30) Foreign Application Priority Data

| | | |
|---|---|---|
| Sep. 29, 2000 | (JP) | 2000-299172 |
| Sep. 29, 2000 | (JP) | 2000-299173 |
| Sep. 29, 2000 | (JP) | 2000-299174 |
| Sep. 29, 2000 | (JP) | 2000-299175 |
| Sep. 29, 2000 | (JP) | 2000-301027 |

(51) Int. Cl.[7] ..... D05C 9/04
(52) U.S. Cl. ..... 112/103
(58) Field of Search ..... 112/470.14, 103, 112/475.11

(56) References Cited

U.S. PATENT DOCUMENTS

| | | | | |
|---|---|---|---|---|
| 5,553,560 A | | 9/1996 | Tajima et al. | |
| 5,649,496 A | | 7/1997 | Morita et al. | |
| 5,887,534 A | * | 3/1999 | French et al. | 112/103 |
| 6,119,609 A | * | 9/2000 | Kawaguchi et al. | 112/103 |

FOREIGN PATENT DOCUMENTS

| | | |
|---|---|---|
| JP | 2-251661 | 10/1990 |
| JP | 5-321123 | 12/1993 |

* cited by examiner

*Primary Examiner*—Ismael Izaguirre
(74) *Attorney, Agent, or Firm*—Pillsbury Winthrop LLP

(57) ABSTRACT

A headgear frame for an embroidering machine comprises: a receiving frame inserted into a cap portion of a headgear having a visor for receiving a peripheral portion of an embroidery range of said cap portion; and a holding band wound around said cap portion for holding said peripheral portion between itself and said receiving frame and including a band member for holding the peripheral portion of said embroidery range on the visor side over the headgear peripheral direction. The band member is provided at its edge portion on the visor side with a positioning member for biting into a stitched portion between said cap portion and said visor, and at its edge portion on the side opposed to said visor side with a holding member for holding the peripheral portion of said embroidery range on the visor side over the headgear peripheral direction.

15 Claims, 17 Drawing Sheets

HEADGEAR FRAME FOR EMBROIDERING MACHINE

BACKGROUND OF THE INVENTION

1. Field of the Invention

The present invention relates to a headgear frame for an embroidering machine adapted to be used for hold a headgear when the cap portion of the headgear is to be embroidered by an embroidering machine.

2. Description of Related Art

FIGS. 11 and 12 show a well-known headgear 61. This headgear 61 is provided with a cap portion 62 to be put on a head and a visor 66 stitched to the front portion 65 of the cap portion 62. To an open edge portion of the cap portion 62, there are stitched a mesh portion 63 arranged on the back side of the front portion 65 and a ring-shaped sweatband portion 64 arranged on the inner side of the cap portion 62.

The cap portion 62 is formed by stitching a plurality of (e.g., six) cloth sheets 67 having generally triangular shapes. In the stitched portion 71 of each cloth sheet 67, there is arranged a margin to stitch of each cloth sheet 67 on the inner side of the cap portion 62. Moreover, each margin to stitch is covered with a cloth band 68 which is arranged on the inner side of the cap portion 62 along the stitched portion 71. Thus, this stitched portion 71 is made thicker than the remaining portions of the cap portion 62.

In the headgear 61, as indicated by double-dotted lines in FIG. 12, the mesh portion 63 and the sweatband portion 64 are extracted from the inner side of the cap portion 62. As indicated by solid lines in FIGS. 11 and 12, the leading end side 63*a* of the mesh portion 63 is folded back to envelop the sweatband portion 64. In this state, the headgear 61 is mounted on the headgear frame. An embroidery range 69 is provided in the front portion 65 of the cap portion 62, for example, as indicated by the double-dotted lines at the cap portion 62 in FIG. 11.

As shown in FIGS. 13 and 14, a headgear frame 81 of the prior art for embroidering the front portion 65 of the cap portion 62 of the headgear 61 is provided with a receiving frame 82 adapted to be inserted into the inner side of the cap portion 62 for receiving the peripheral portion 70 of the embroidery range 69 of the front portion 65, and a holding band 83 made of an elastic metal sheet and wound around the cap portion 62 for holding the peripheral portion 70 between itself and the receiving frame 82. The holding band 83 is provided with a pair of band members 84 and 85 for holding the upper and lower peripheral portions 70*a* and 70*b* in the headgear height direction of the embroidery range 69 all over the headgear peripheral direction, and a pair of joint portions 88 for holding the peripheral portions 70*c* and 70*c*. The band member 84 on the top side and the joint portions 88 are provided with a slip preventing rubber member 86 on the face opposed to the receiving frame 82. Thus in the headgear frame 81 of the prior art, the holding band 83 holds the peripheral portion 70 of the embroidery range 69 exclusively.

The headgear frame 81 supports, where it is attached to a drive unit 101 for driving itself, the embroidery range 69 just above a needle plate 105 in a bed 102 of the machine. By the cooperations among the headgear frame 81 driven by the drive unit 101, a needle 104 carried vertically movably by a machine head 103 and a rotating hook built in the bed 102, moreover, an embroidered pattern is formed in the embroidery range 69.

In the upper face of the receiving frame 82, there are formed a first aperture 89 for arranging the embroidery range 69 and a second aperture 90 for releasing the margins to stitch in the stitched portions of the cap portion 62, the visor 66, the mesh portion 63 and the sweatband portion 64.

In a headgear frame 91 of the prior art for embroidering the generally entire periphery of the cap portion 62 of the headgear 61, as shown in FIG. 15, the upper side and the lower side of the visor 66 are individually held on a receiving frame 92 by a holding band 93 having a pair of upper and lower band members 94 and 95. The band member 94 for holding the upper side of the visor 66 is provided along the edge portion of the band member 94 on the visor side with a positioning member 96 for biting into a stitched portion 77 between the cap portion 62 and the visor 66. Here, the shown headgear 61 is not provided with the mesh portion 63.

However, the headgear frames 81 and 91 of the prior art are encountered by the following problems (1) to (5).

(1) To the stitched portion 77 between the cap portion 62 and the visor 66, there are additionally stitched the mesh portion 63 and the sweatband portion 64. On the inner side of the cap portion 62 in the stitched portion 77, there are concentrated the margins to stitch of the cap portion 62, the. visor 66, the mesh portion 63 and the sweatband portion 64. When the headgear 61 having the mesh portion 63 and the sweatband portion 64 folded back is to be mounted on the headgear frame 81 of the prior art for embroidering the front portion 65 of the cap portion 62, moreover, the folded-back cloth and the aforementioned margins to stitch ride on the upper face of the root end of the receiving frame 82, as shown in FIG. 14. Therefore, the front portion 65 of the cap portion 62 on the side of the visor considerably floats from the needle plate 105. This float is different according to the structure of the stitched portion 77 and the kind/thickness of the cloth of the individual portions composing the headgear 61 but is exemplified by about 3 to 7 mm. If the visor side of the front portion 65 is held and fastened by the band member 85 made of a flat sheet (which may include the rubber member), the holding is made due to the step from the upper face of the receiving frame 82 receiving the mesh portion 63 and the sweatband portion 64 such that the band member 85 drops oppositely of the visor side from the stitched portion 77 between the front portion 65 and the visor 66, as indicated by arrows (of double-dotted lines) in FIG. 14. This drop is prominently found at the stitched portion 77 between the cap portion 62 and the visor 66 at the center of the front portion 65. Especially at the center of the front portion 65 of the cap portion 62, therefore, there arises a problem that the portion near the visor 66 is difficult to embroider. In the vicinity of the boundary between the cap portion 62 and the visor 66 of the headgear 61, for example, the embroidered pattern extending in parallel with that boundary has to be formed by shifting its entirety to the top side by considering the aforementioned drop of the band member 85.

In the headgear frame 91 of the prior art for embroidering the substantially entire periphery of the cap portion 62, on the other hand, the positioning member 96 bites into the stitched portion 77 between the cap portion 62 and the visor 66 to hold the stitched portion 77 but not the cloth of the front portion 65 of the cap portion 62. Where the cap portion 62, the visor 66, the mesh portion 63 or the sweatband portion 64 is made of thick cloth (especially, a baseball cap), as shown in FIG. 15, the cloth largely floats at the front portion 65 of the cap portion 62 on the side of the visor 66 so that it flaps while being embroidered, to raise a problem that the embroidery quality drops.

(2) As described in (1), the visor side of the front portion 65 of the cap portion 62 largely floats with respect to the needle plate 105. In the headgear 61 having the large float, the band member 85 on the visor side largely floats from the upper face of the receiving frame 82 so that the band member 84 on the top side, as formed integrally with the band member 85 on the visor side, also floats from the upper face of the receiving frame 82 to raise a problem that the holding of the cap portion 62 by the band member 84 on the top side is weakened.

(3) In the cap portion 62, as shown in FIG. 16, the stitched portion 71 is made thicker than the remaining portion of the cap portion 62 by the margin to stitch of the cloth 67 and the cloth band 68 covering the margin. If the headgear 61 having the stitched portion 71 of the cap portion 62 in the embroidery range (i.e., at the center of the front portion 65 in the headgear example shown in FIGS. 11 and 12) is mounted on the headgear frame 81, the stitched portion 71 bulges from the remaining portions in the embroidery range to raise a problem that the embroidery quality in the stitched portion 71 is degraded.

(4) When the headgear 61 is mounted on the headgear frame 81 of the prior art, as shown in FIG. 17, the visor 66 rises generally vertically from the surface of the front portion 65 of the cap portion 62. When the vicinity of the visor side of the front portion 65 is to be embroidered, therefore, the portion at the back of the needle 104 of the machine head 103 interferes with the visor 66, as indicated by double-dotted lines in FIG. 17. Therefore, it is necessary to incline the visor 66 forcibly away from the embroidery range 69. Thus, there arises a problem that it is necessary to add a device for holding the visor 66 in an inclined position and an operation of that device for mounting the headgear 61. As the case may be, moreover, when the visor 66 is to be forcibly inclined, the mounted position of the headgear 61 on the headgear frame 81 may be shifted to mount the headgear 61 again.

(5) As described in (1), when the headgear 61 in the state of FIGS. 11 and 12 is mounted on the headgear frame 81 of the prior art, the visor side of the front portion 65 is raised away from the upper face of the receiving frame 82, as indicated by the double-dotted lines in FIG. 14. With the visor side floating from the upper face of the receiving frame 82, therefore, the headgear 61 may be mounted on the headgear frame 81. In this case, the cloth of the front portion 65 flaps during the embroidery to raise a problem that the embroidery quality drops.

SUMMARY OF THE INVENTION

A first object of the invention is to provide a headgear frame for an embroidering machine, which can solve the above-specified problems, can prevent the embroidery range of the cap portion of the headgear from becoming narrow and can reduce the float of the cloth on the visor side of the cap portion.

A second object of the invention is to provide a headgear frame for an embroidering machine, which can solve the above-specified problems and can hold the upper and lower peripheral portions of the embroidery range in the headgear height direction substantially homogeneously.

A third object of the invention is to provide a headgear frame for an embroidering machine, which can solve the above-specified problems and can improve the quality of embroidery at the stitched portion in the embroidery range.

A fourth object of the invention is to provide a headgear frame for an embroidering machine, which can solve the above-specified problems and can incline the visor of the headgear easily in the direction away from the embroidery range.

A fifth object of the invention is to provide a headgear frame for an embroidering machine, which can solve the above-specified problems and can reduce the float of a cloth at the front portion of the cap portion of the headgear on the visor side.

In order to achieve the first object, according to the invention, there is provided a headgear frame for an embroidering machine, comprising: a receiving frame inserted into the cap portion of a headgear having a visor for receiving the peripheral portion of the embroidery range of said cap portion; and a holding band wound around said cap portion for holding said peripheral portion between itself and said receiving frame and including a band member for holding the peripheral portion of said embroidery range on the visor side over the headgear peripheral direction, wherein said band member is provided at its edge portion on the visor side with a positioning member for biting into a stitched portion between said cap portion and said visor, and at its edge portion on the side opposed to said visor side with a holding member for holding the peripheral portion of said embroidery range on the visor side over the headgear peripheral direction.

It is possible to exemplify a mode wherein said positioning member is formed to bite into said stitched portion at least on the front central side of said cap portion.

It is possible to exemplify a mode wherein said positioning member is so formed over the substantial entirety of the peripheral portion of said embroidery range on the visor side as to bite into said stitched portion.

It is possible to exemplify a mode wherein said holding member has a larger protrusion than that of said positioning member. The difference in the protrusion length between the positioning member and the holding member is not limited to any specific one but is preferably about 1 mm or more and more preferably about 2 mm or more.

The spacing between the positioning member and the holding member is not limited to any specific one but can be exemplified by about 3 to 10 mm and preferably about 5 mm. By adjusting this spacing, there is adjusted the spacing between the position of the stitched portion and the held position of the holding member. This spacing is preferred to be suitably set according to the kind/thickness of the cloth of the headgear and the structure of the stitched portion.

In order to achieve the second object, according to the invention, there is provided a headgear frame for an embroidering machine, comprising: a receiving frame inserted into the cap portion of a headgear for receiving the peripheral portion of the embroidery range of said cap portion; and a holding band wound around said cap portion for holding said peripheral portion between itself and said receiving frame and including a pair of band members for holding the upper and lower peripheral portions of said embroidery range individually in the headgear height direction, wherein the upper band member in said headgear height direction is made shorter than the other band member.

It is possible to exemplify a mode wherein the relative lengths of said two band members are made adjustable. It is also possible to exemplify a mode wherein the relative spacing of said two band members is made adjustable.

In order to achieve the third object, according to the invention, there is provided a headgear frame for an embroidering machine, comprising: a receiving frame inserted into the cap portion of a headgear having a thicker stitched portion in an embroidery range than the remaining portions for receiving the peripheral portion of the embroidery range of said cap portion; and a holding band wound around said cap portion for holding said peripheral portion between itself and said receiving frame, wherein said receiving frame is provided in its upper face with a recess for releasing the excess thickness in said stitched portion than the remaining portions.

It is possible to exemplify a mode wherein said receiving frame is provided on its upper face with a non-slip member for preventing the cap portion from going out of position, and wherein said recess is formed by arranging not said non-slip member in the portion of said recess.

It is also possible to exemplify a mode wherein said receiving frame is provided on its upper face with a non-slip member for preventing the cap portion from going out of position, and wherein said recess is formed in the upper face of said non-slip member.

It is possible to exemplify a mode wherein said holding band is provided with a second recess at a position corresponding to said recess, in the face confronting the upper face of said receiving frame.

In order to achieve the fourth object, according to the invention, there is provided a headgear frame for an embroidering machine, comprising: a receiving frame inserted into the cap portion of a headgear having a visor for receiving the peripheral portion of the embroidery range of said cap portion; and a holding band wound around said cap portion for holding said peripheral portion between itself and said receiving frame, wherein said holding band holds said peripheral portion and either the two side portions of the visor of said headgear or the cap portion in the vicinity of the root sides of said two side portions so that said two side portions may come closer to each other.

It is possible to exemplify a mode wherein said holding band is provided with a holding portion for holding either said two side portions or the cap portion in the vicinities of the root sides of said two side portions.

It is possible to exemplify a mode wherein said holding band is provided with a positioning member for positioning either the vicinities of said root sides or the cap portion in the vicinities of said root sides.

It is possible to exemplify a mode wherein said receiving frame is provided with a recess or an opening in the upper face at positions corresponding to the root sides of the two side portions of said visor.

It is possible to exemplify a mode wherein said receiving frame is so constructed as to adjust the size of said recess or said opening.

In order to achieve the fifth object, according to the invention, there is provided a headgear frame for an embroidering machine adapted to be used for holding a headgear in which a mesh portion arranged on the back side of the front portion of a cap portion and a ring-shaped sweatband portion arranged on the inner side of said cap portion are stitched on the open edge portion of said cap portion, and comprising: a receiving frame inserted into the cap portion of a headgear having a visor for receiving the peripheral portion of the embroidery range of said cap portion; and a holding band wound around said cap portion for holding said peripheral portion between itself and said receiving frame, wherein said receiving frame is provided with a recess or opening for releasing said mesh portion and said sweatband portion, as extracted from said cap portion so that they may be removed from said embroidery range.

It is possible to exemplify a mode wherein said recess or said opening is made adjustable in size.

Further objects of this invention will become evident upon an understanding of the illustrative embodiments described below. Various advantages not specifically referred to herein but within the scope of the instant invention will occur to one skilled in the art upon practice of the presently disclosed invention. The following examples and embodiments are illustrative and not seen to limit the scope of the invention.

DETAILED DESCRIPTION OF THE PREFERRED EMBODIMENTS

Figure 4:
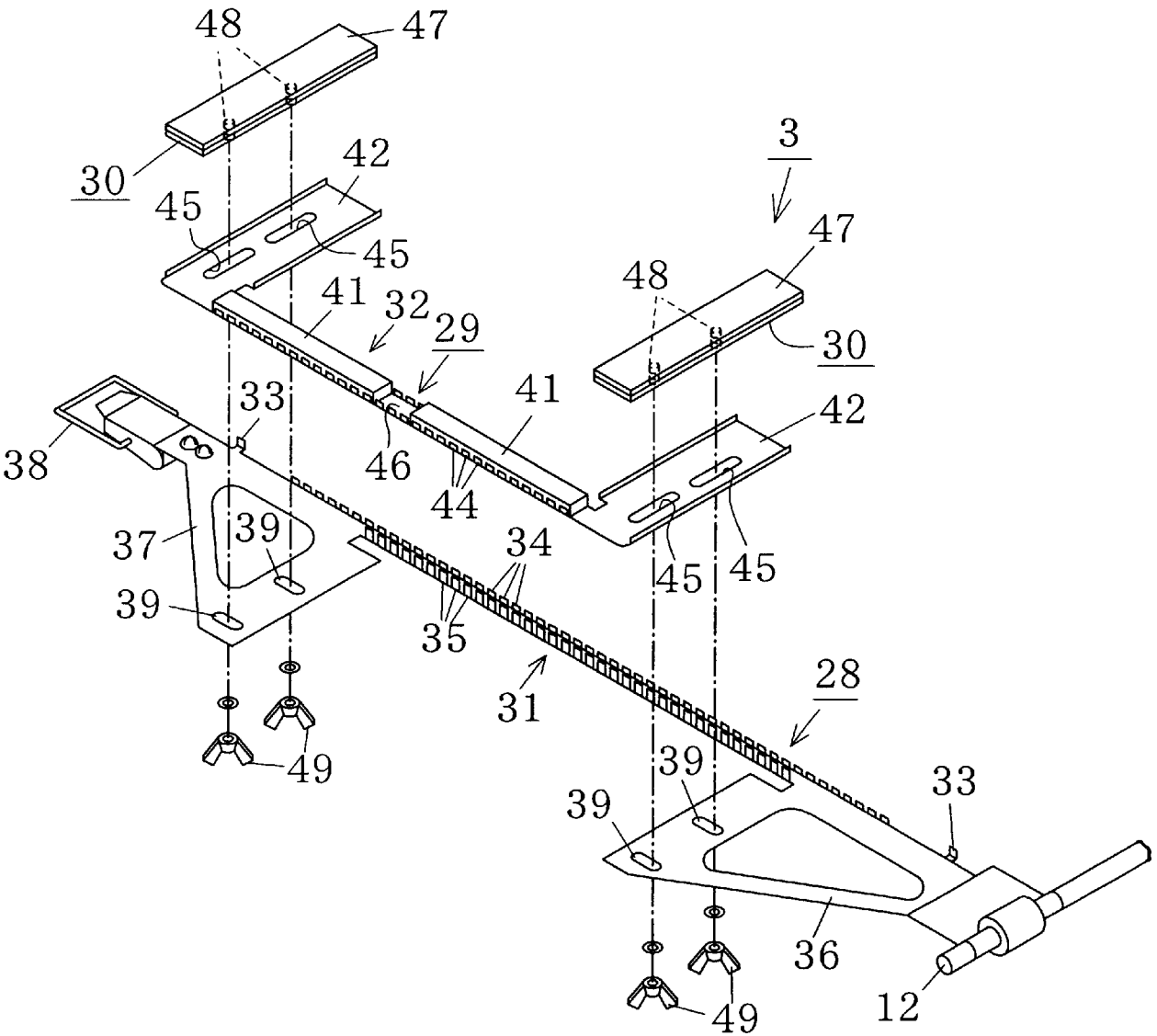
FIG. 4 is an exploded perspective view showing a holding band of the same headgear frame.
Figure 5:
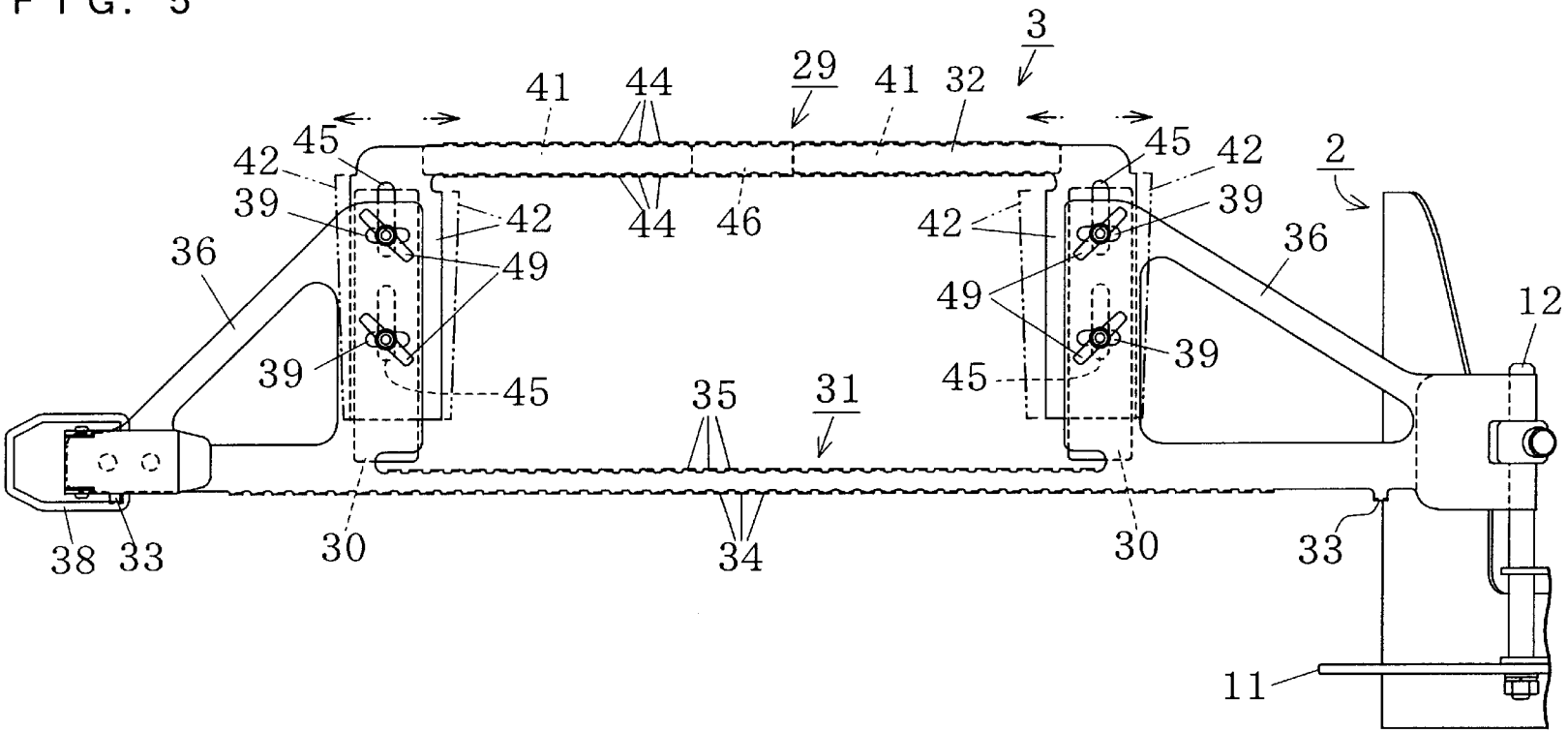
FIG. 5 is a top plan view of the same holding band.
Figure 6:
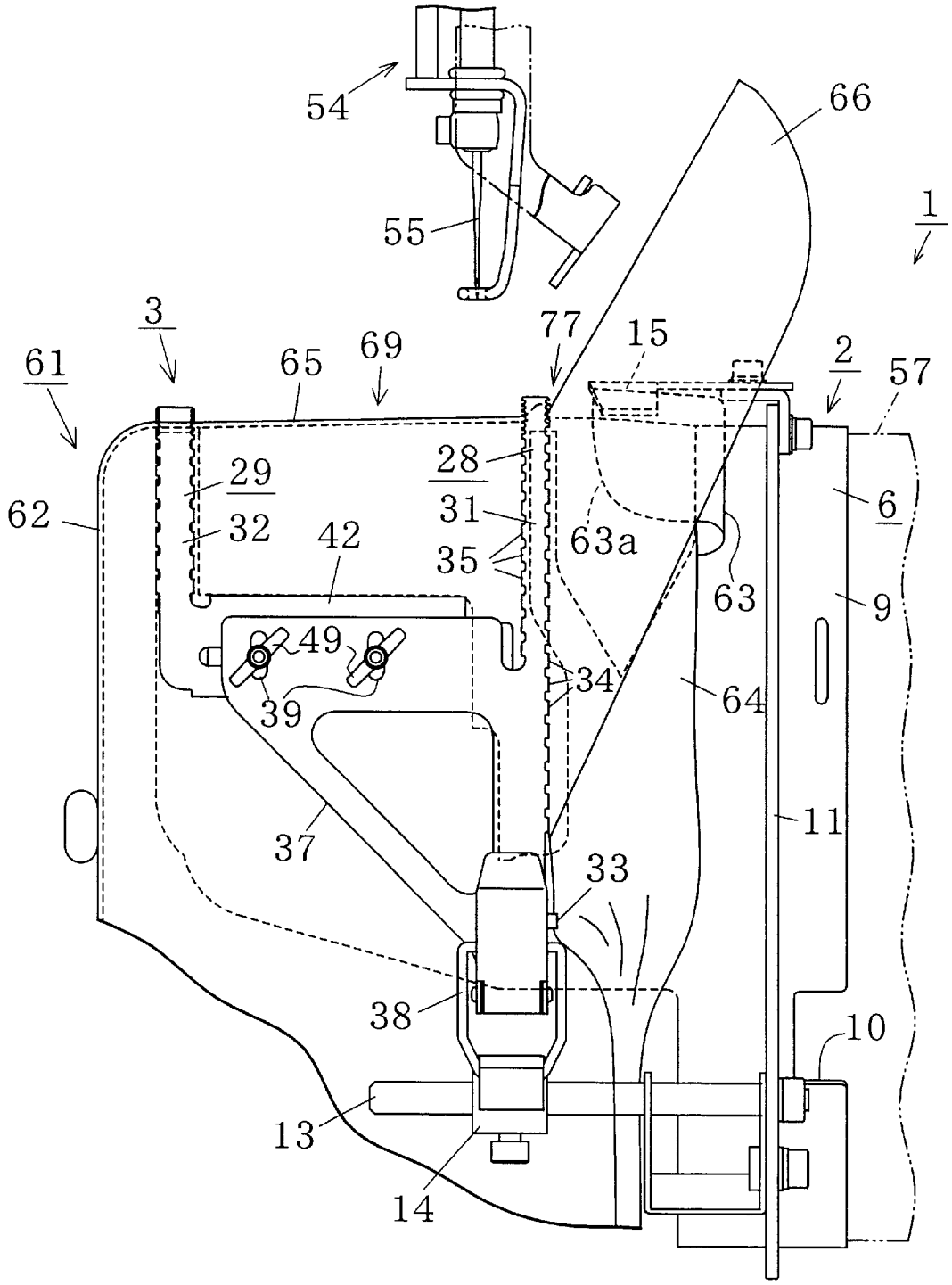
FIG. 6 is a side elevation showing the state in which a headgear is mounted on the same headgear frame.
Figure 7:
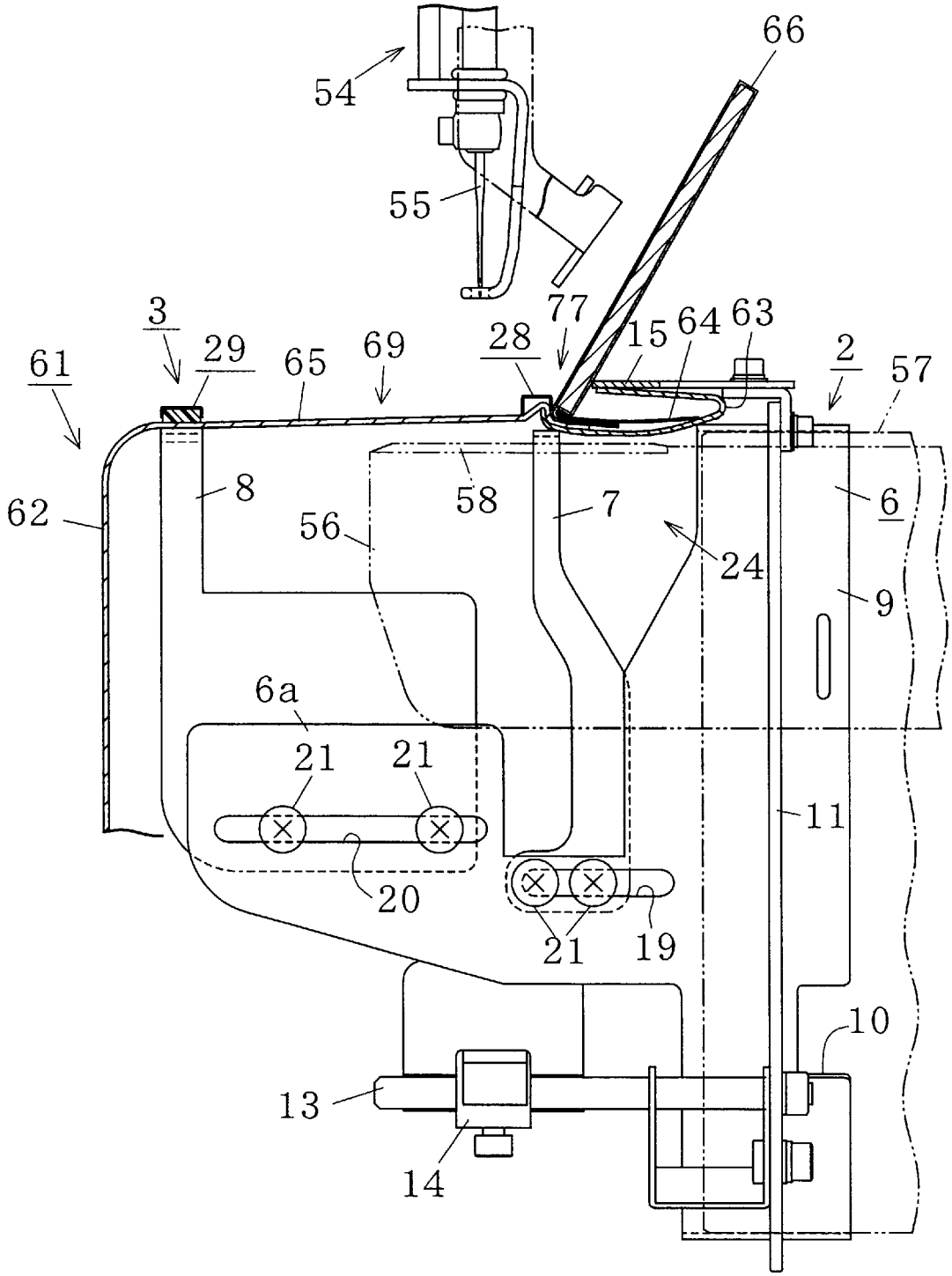
FIG. 7 is a sectional side elevation showing the state in which the headgear is mounted on the same headgear frame.
Figure 8:
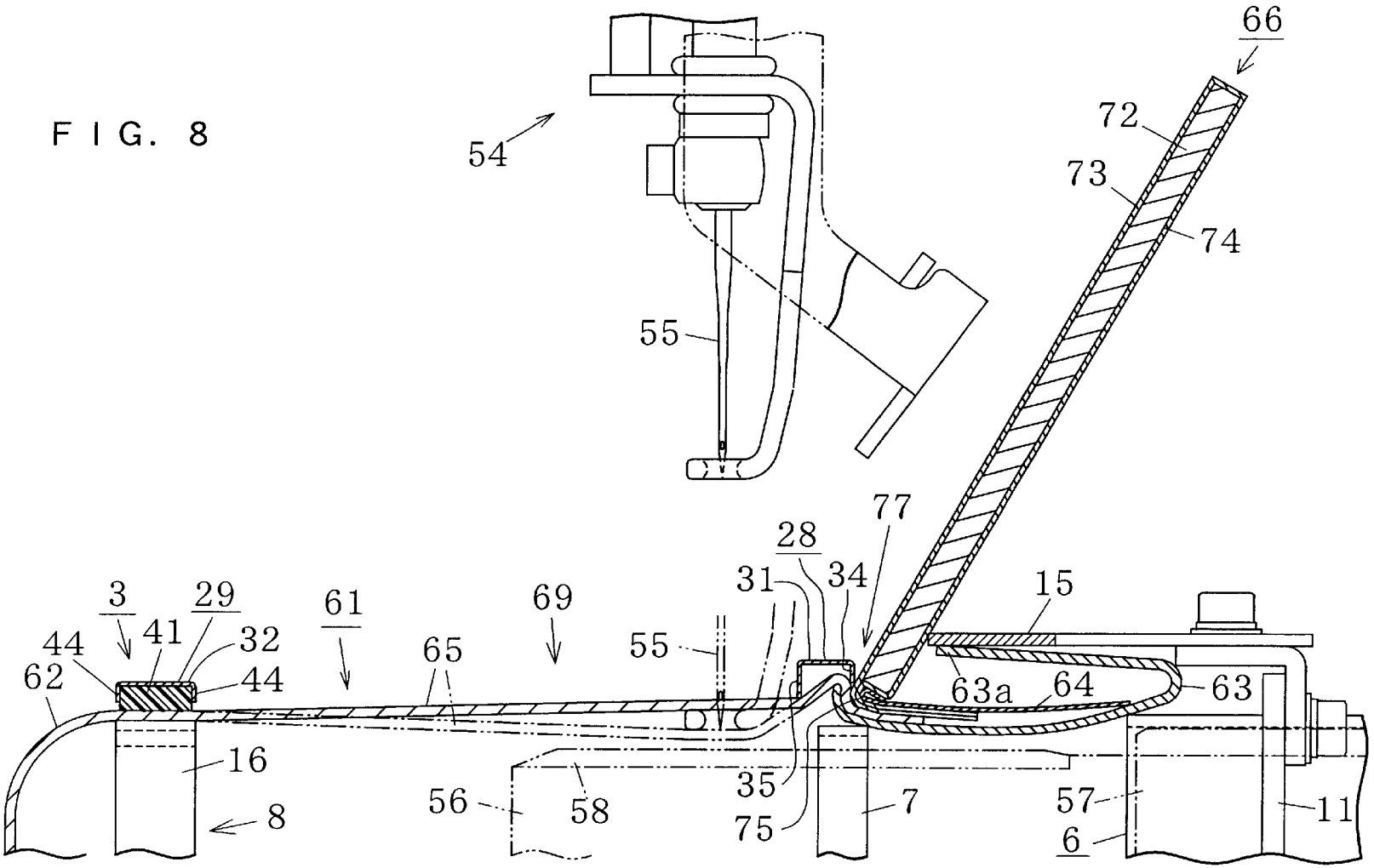
FIG. 8 is an enlarged view of a portion of FIG. 7.

FIGS. 1 to 10 show a headgear frame 1 for an embroidering machine according to one embodiment of the invention. This headgear frame 1 supports, when mounted on a drive unit 57 for driving it, as shown in FIGS. 6 to 8, an embroidery range 69 generally above a needle plate 58 in a machine bed 56. Moreover, an embroidered pattern is formed in the embroidery range 69 by the cooperation of the headgear frame 1 driven by the drive unit 57, a needle 55 attached vertically movably in a machine head 54, and the (not-shown) rotating hook built in the bed 56.

Figure 1:
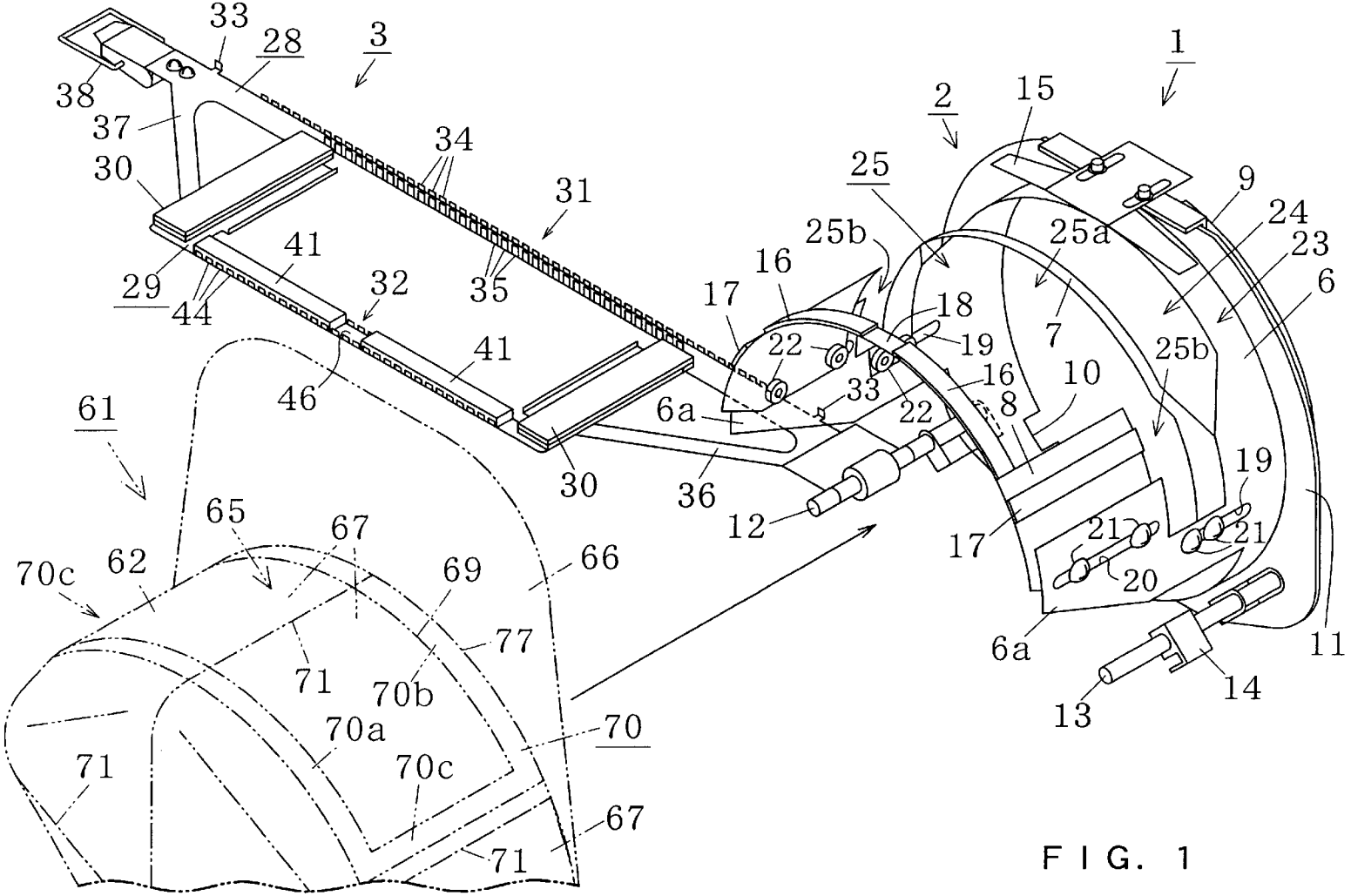
FIG. 1 is a perspective view showing a headgear frame for an embroidering machine according to an embodiment of the invention.
Figure 11:
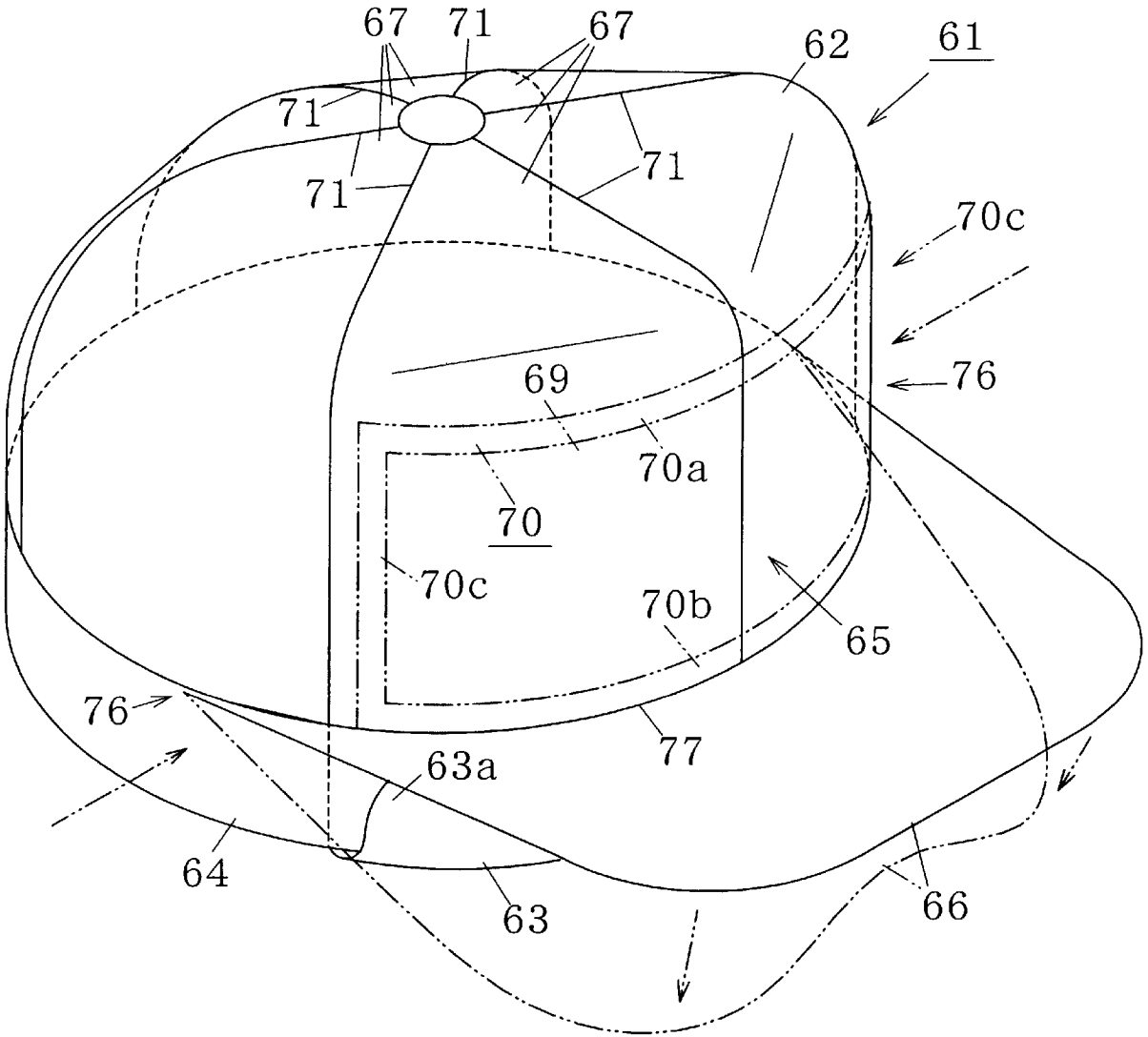
FIG. 11 is a perspective view showing the state in which a well-known headgear is viewed obliquely downward from its front side.
Figure 12:
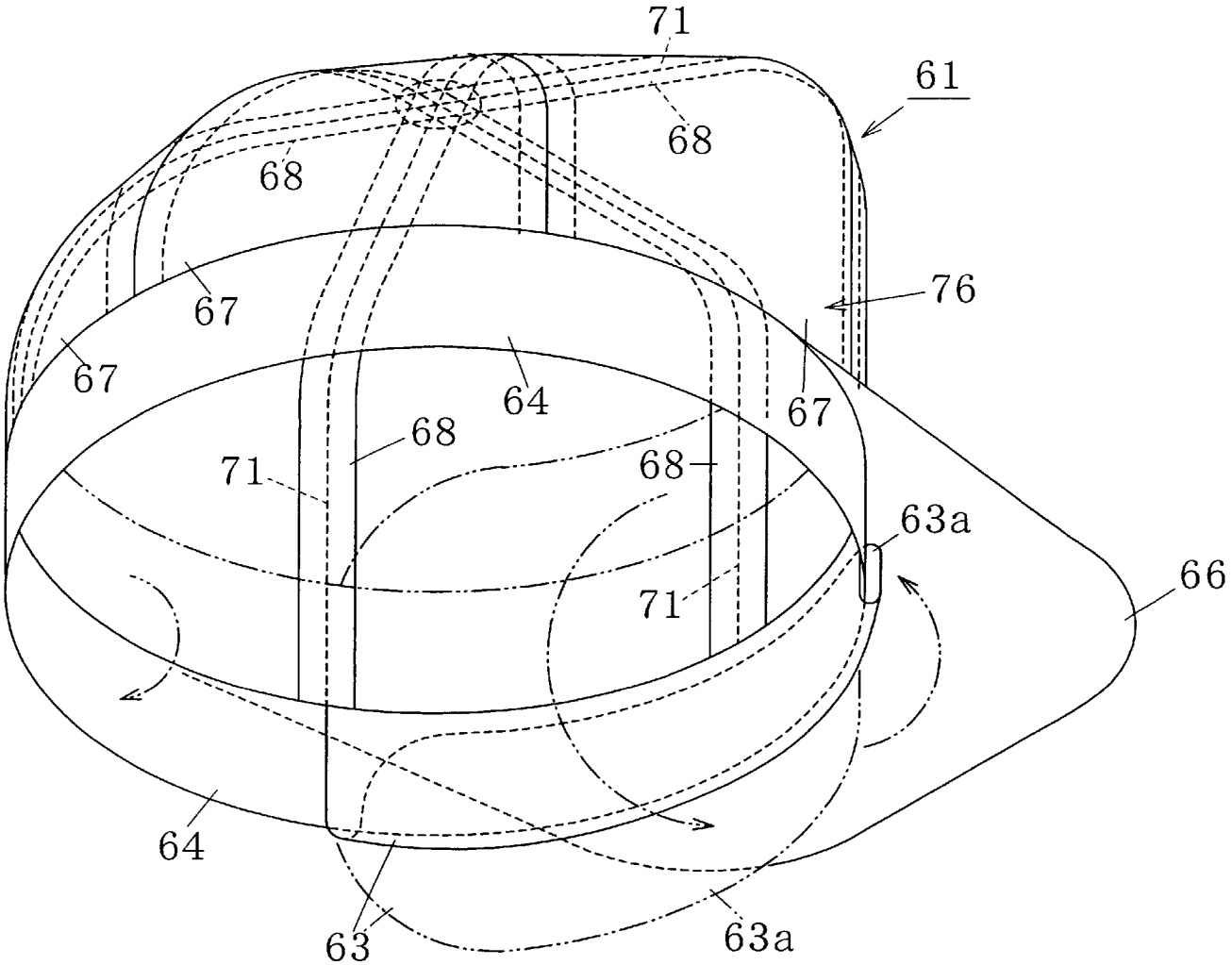
FIG. 12 is a perspective view showing the state in which the same headgear is viewed obliquely upward from its rear side.
Figure 13:
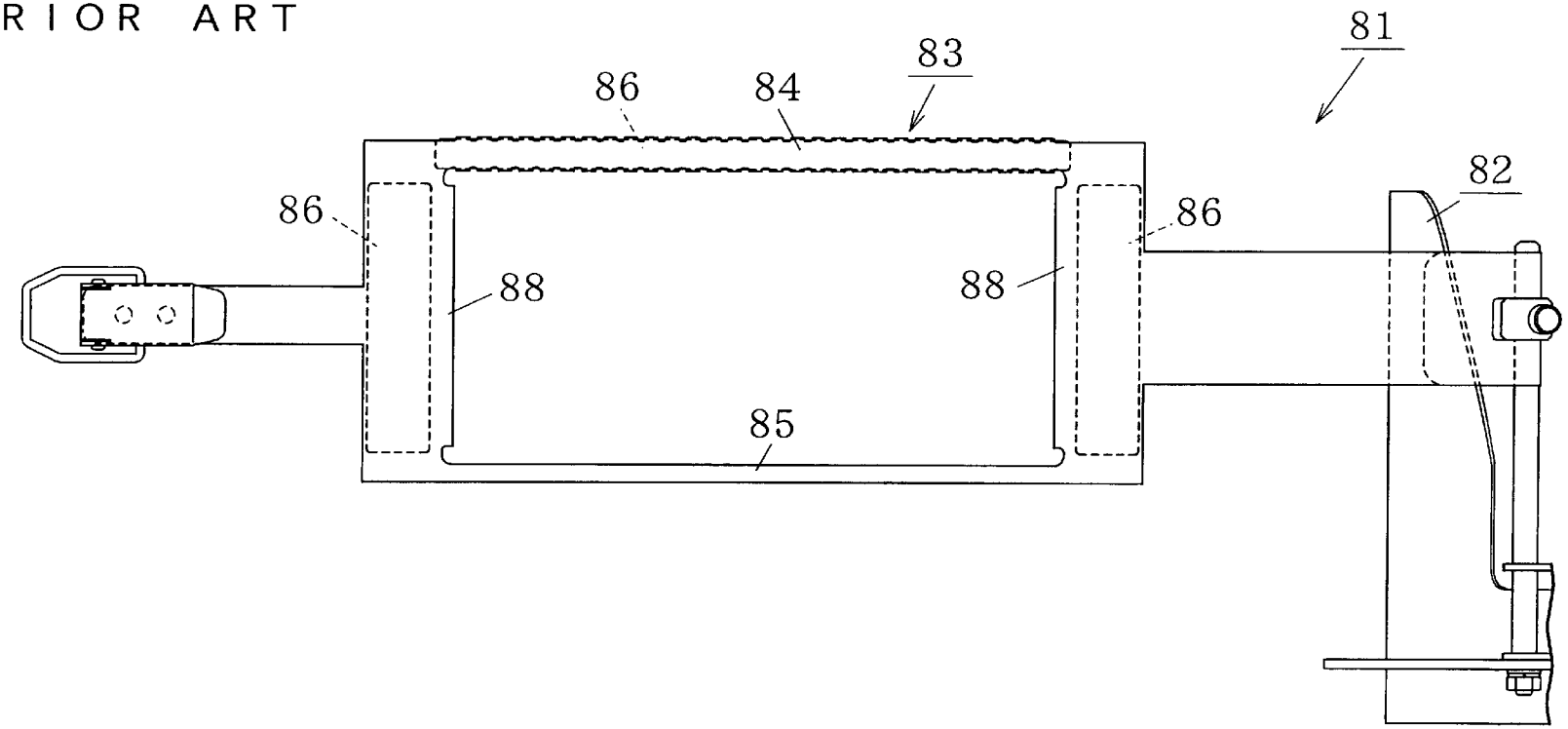
FIG. 13 PRIOR ART
FIG. 13 is a diagram showing a headgear frame of the prior art.
Figure 14:
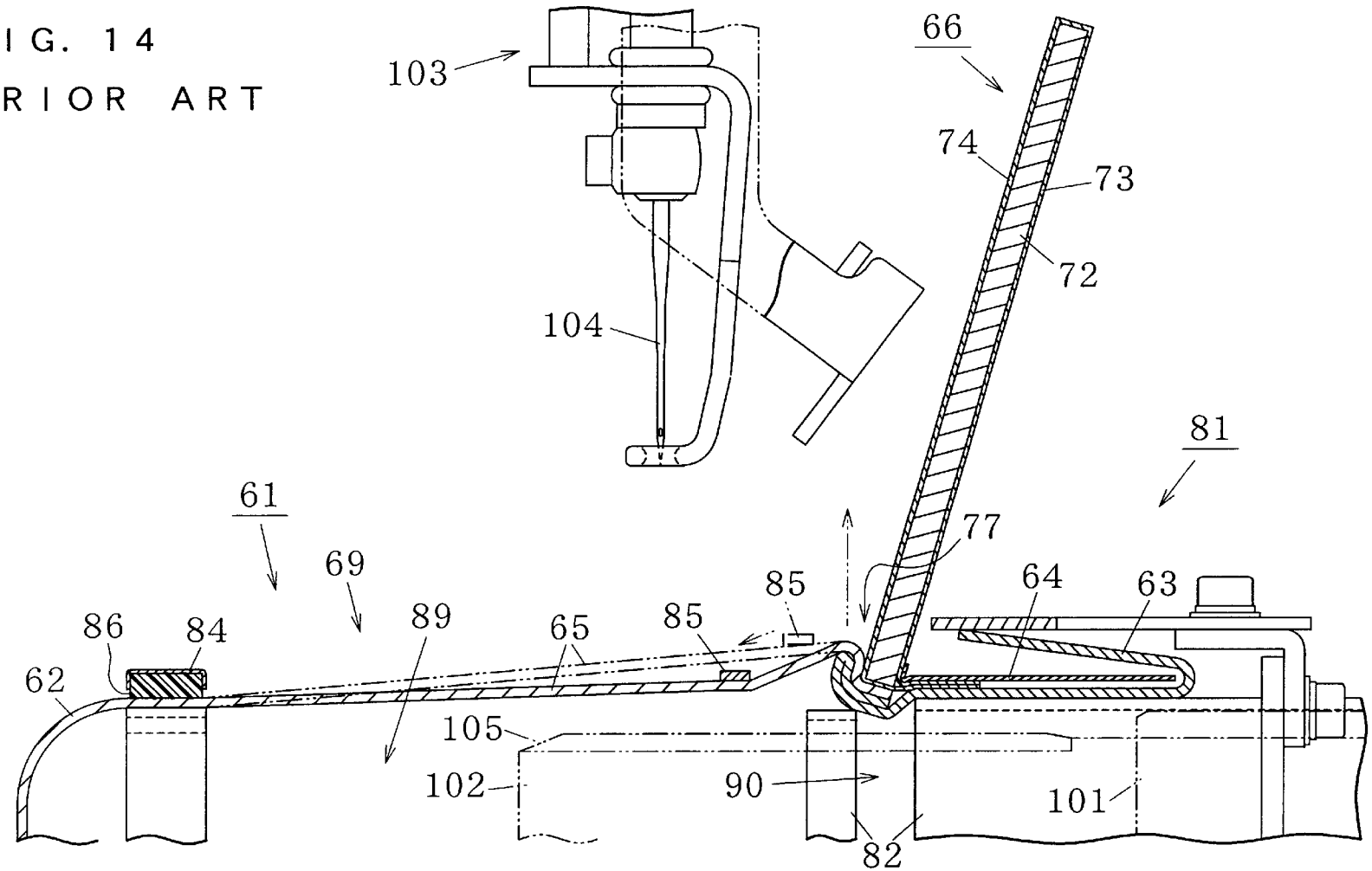
FIG. 14 PRIOR ART
FIG. 14 is a sectional side elevation showing the state in which a headgear is mounted on the same headgear frame.
Figure 15:
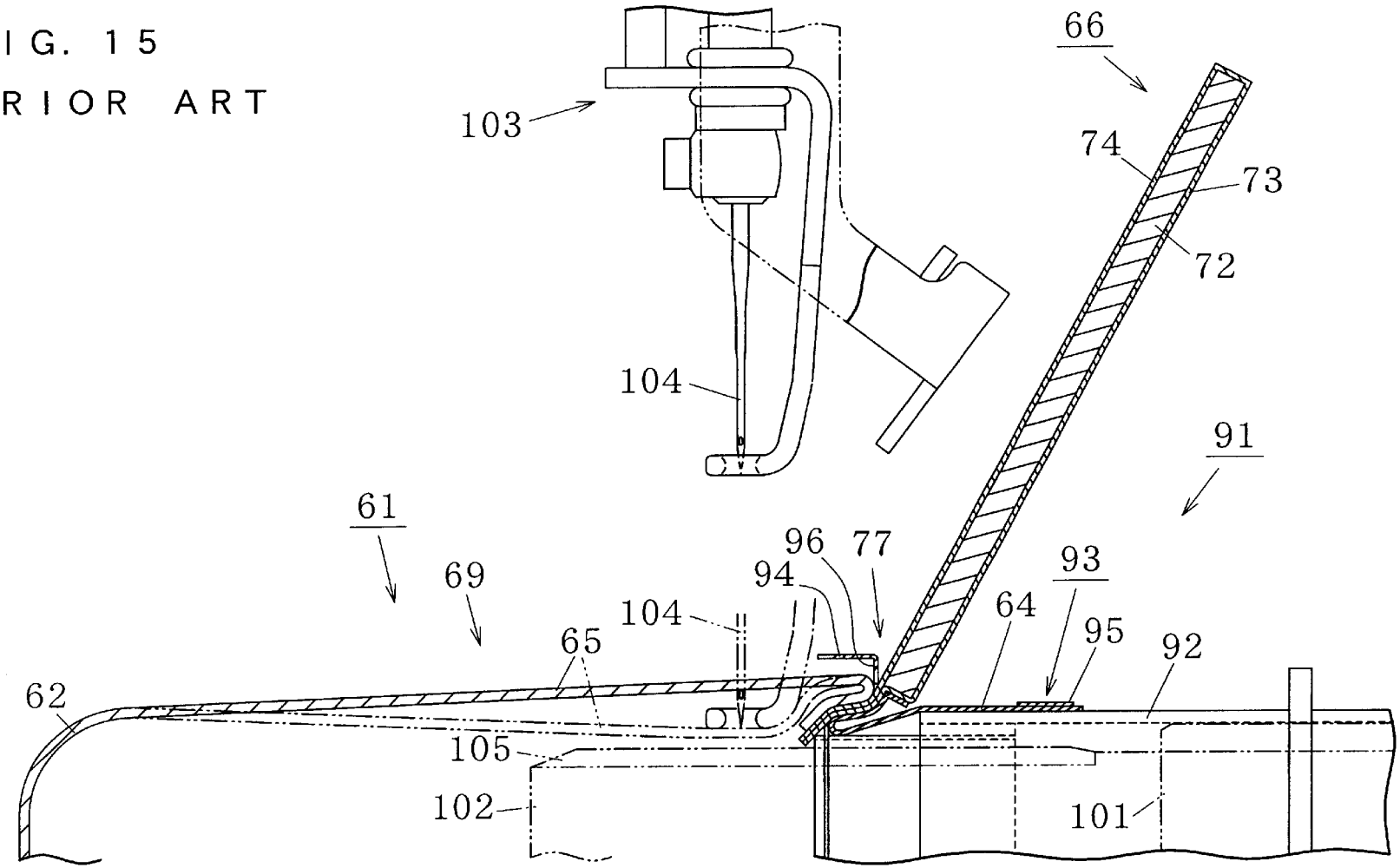
FIG. 15 PRIOR ART
FIG. 15 is a sectional side elevation showing the state in which a headgear is mounted on another headgear frame of the prior art.
Figure 16:
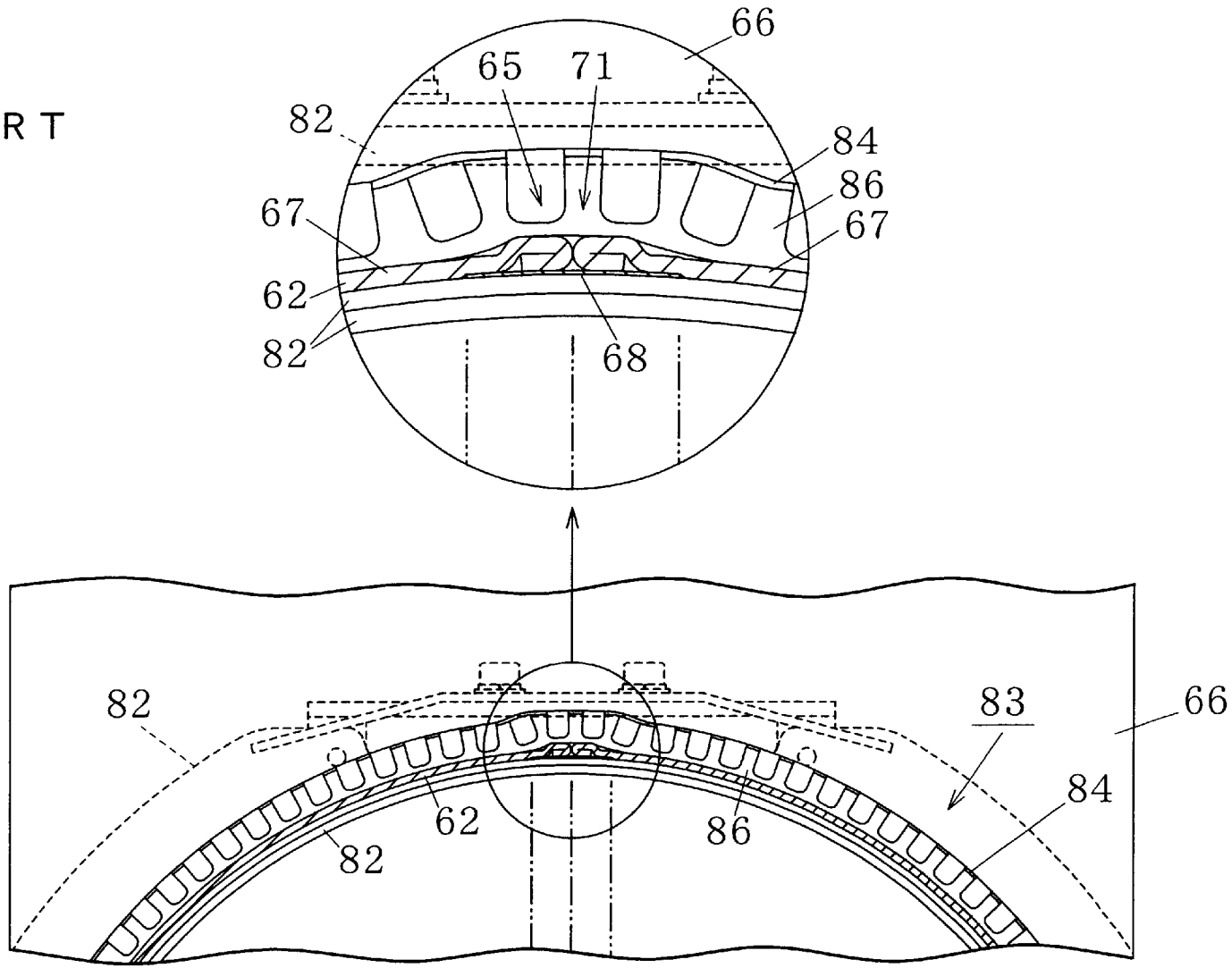
FIG. 16 PRIOR ART
FIG. 16 is a sectional front elevation showing the state in which the headgear is mounted on the same headgear frame.
Figure 17:
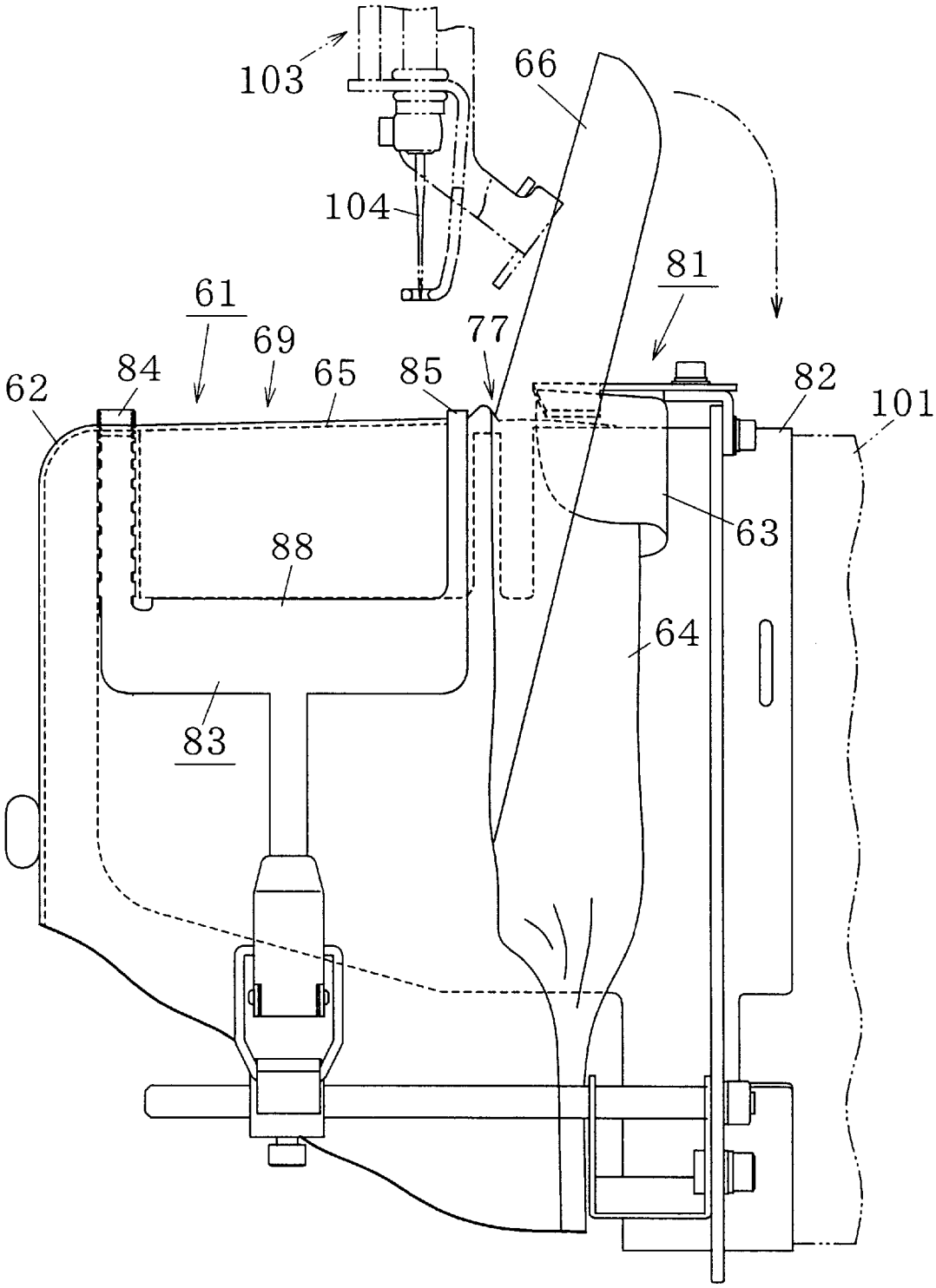
FIG. 17 PRIOR ART
FIG. 17 is a sectional front elevation showing the state in which the headgear is mounted on the same headgear frame.

As shown in FIG. 1, the headgear frame 1 is equipped with a receiving frame 2 inserted into a cap portion 62 of a well-known headgear 61 shown in FIGS. 11 and 12 for receiving the peripheral portion 70 of the embroidery range 69 of the headgear 61, and a holding band 3 wound around the cap portion 62 for holding the peripheral portion 70 between itself and the receiving frame 2.

Figure 2:
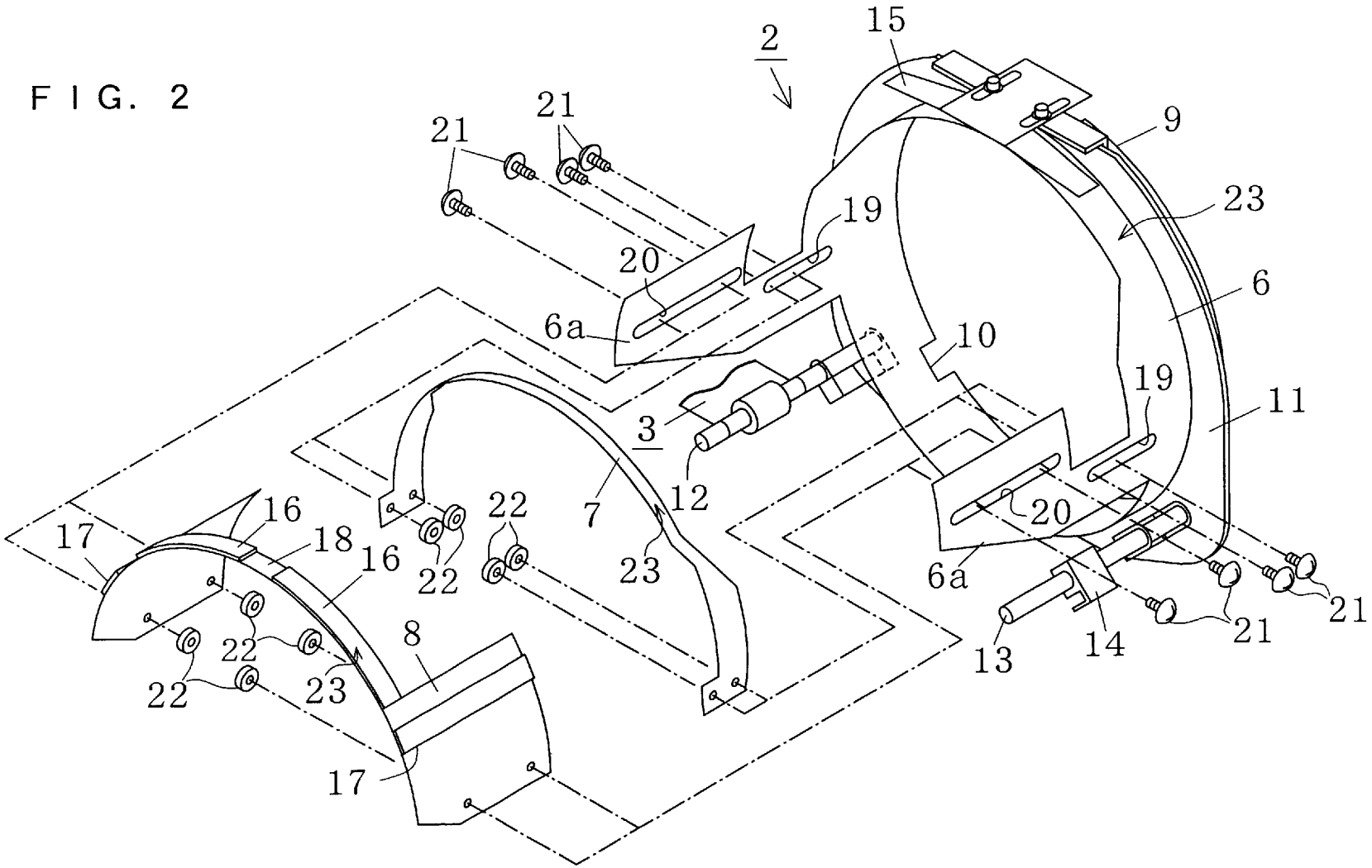
FIG. 2 is an exploded perspective view showing a receiving frame of the same headgear frame.
Figure 3:
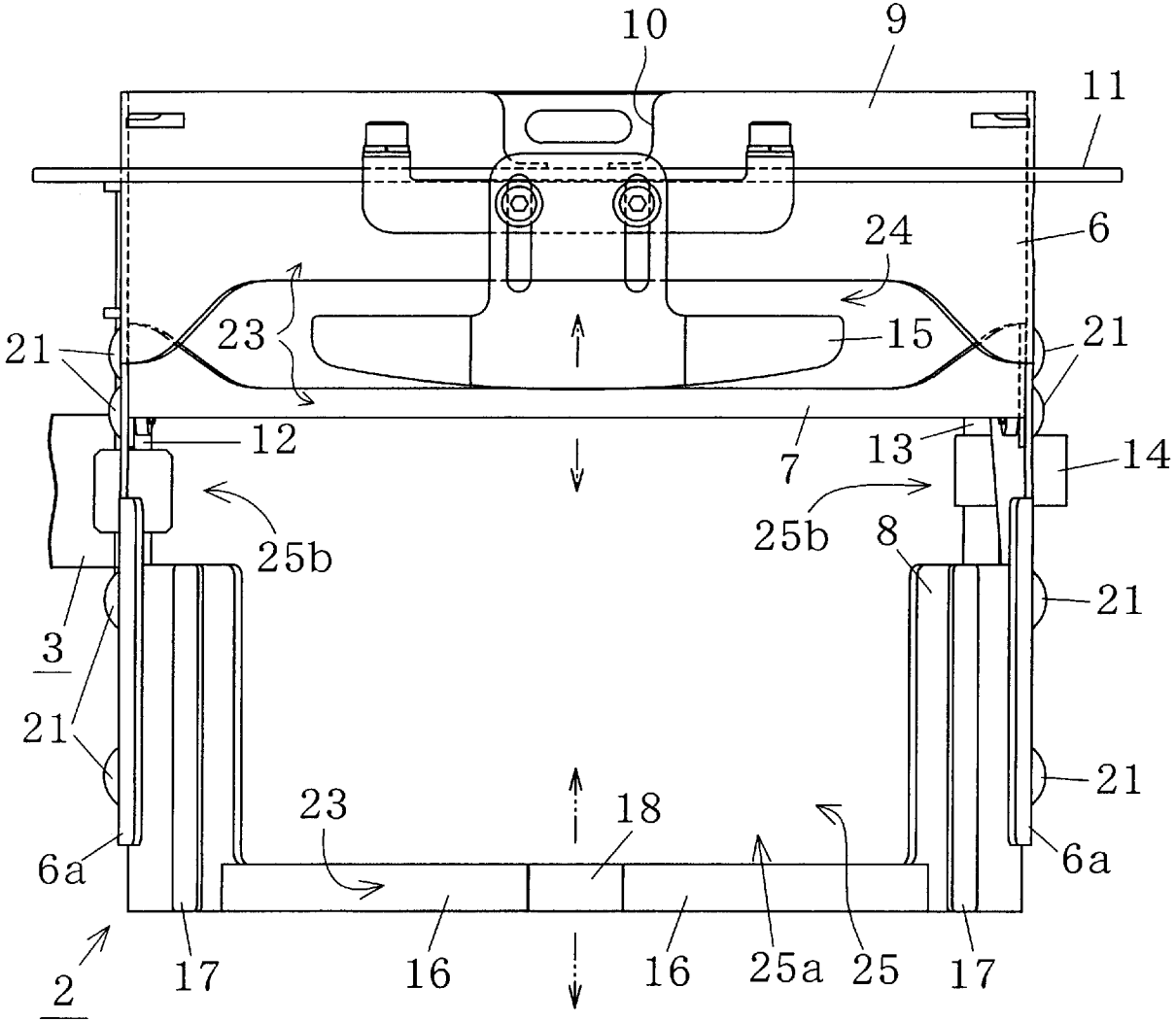
FIG. 3 is a top plan view of the same receiving frame.

The receiving frame 2 will be described first of all. The receiving frame 2 is formed into a hollow cylindrical shape, as shown in FIGS. 2 and 3, to arrange the bed 56 of the embroidering machine therein. The receiving frame 2 has its one axial end formed into a free end to be covered with the headgear 61 and its other end formed into a root end connected to the drive unit 57 for driving the headgear frame 1. This receiving frame 2 is equipped with a receiving frame body 6 for receiving a mesh portion 63 and a sweatband portion 64 of the headgear 61 mainly; a first adjusting frame 7 for receiving a visor side peripheral portion 70*b* of the embroidery range 69 mainly, and a second adjusting frame 8 for receiving the top side peripheral portion 70*a* and the two side peripheral portions 70*c* and 70*c* of the embroidery range 69 mainly.

The receiving frame body 6 is formed on the root side of the receiving frame 2 into a connecting portion 9 to be jointed to the drive unit 57, and the connecting portion 9 is provided with a plurality of fitting recesses 10 for positioning the drive unit 57. On the outer periphery of the receiving frame body 6, there is formed a flange portion 11 which is located generally at the axial center in the axial direction of the receiving frame body 6. On the side of the flange portion 11 where the rear portion of the cap portion 62 is arranged, there are provided a pair of connecting rods 12 and 13 which are spaced from each other. These two connecting rods 12 and 13 are individually extended in parallel with the axial direction of the receiving frame 2. To one connecting rod 12, there is turnably connected one end of the holding band 3. On the other connecting rod 13, there is mounted a retaining member 14 for retaining the other end of the holding band 3 removably. On the side of the flange portion 11 where the front portion of the cap portion 62 is arranged, on the other hand, there is mounted a holding plate portion 15 for receiving the mesh portion 63 and the sweatband portion 64, as extracted from the inner side of the cap portion 62 of the headgear 61, and holding it on the upper face of the frame body 6. At the free end of the receiving frame 2 of the receiving frame body 6 and on the side where the side portion 76 of the cap portion 62 is arranged, there is integrally formed a mounting portion 6*a* for mounting the first adjusting frame 7 and the second adjusting frame 8.

Figure 9:
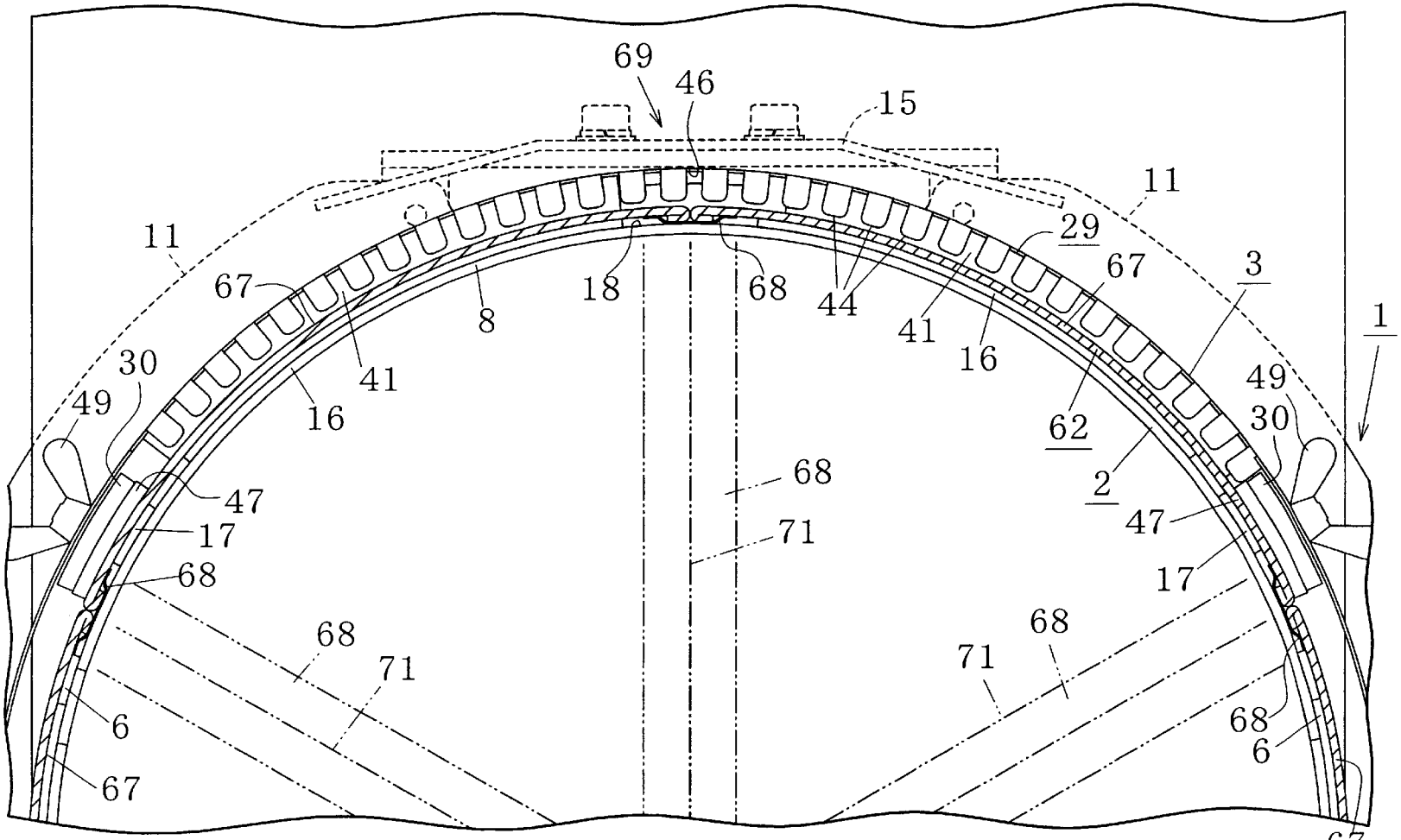
FIG. 9 is a sectional front elevation showing the state in which the headgear is mounted on the same headgear frame.
Figure 10:
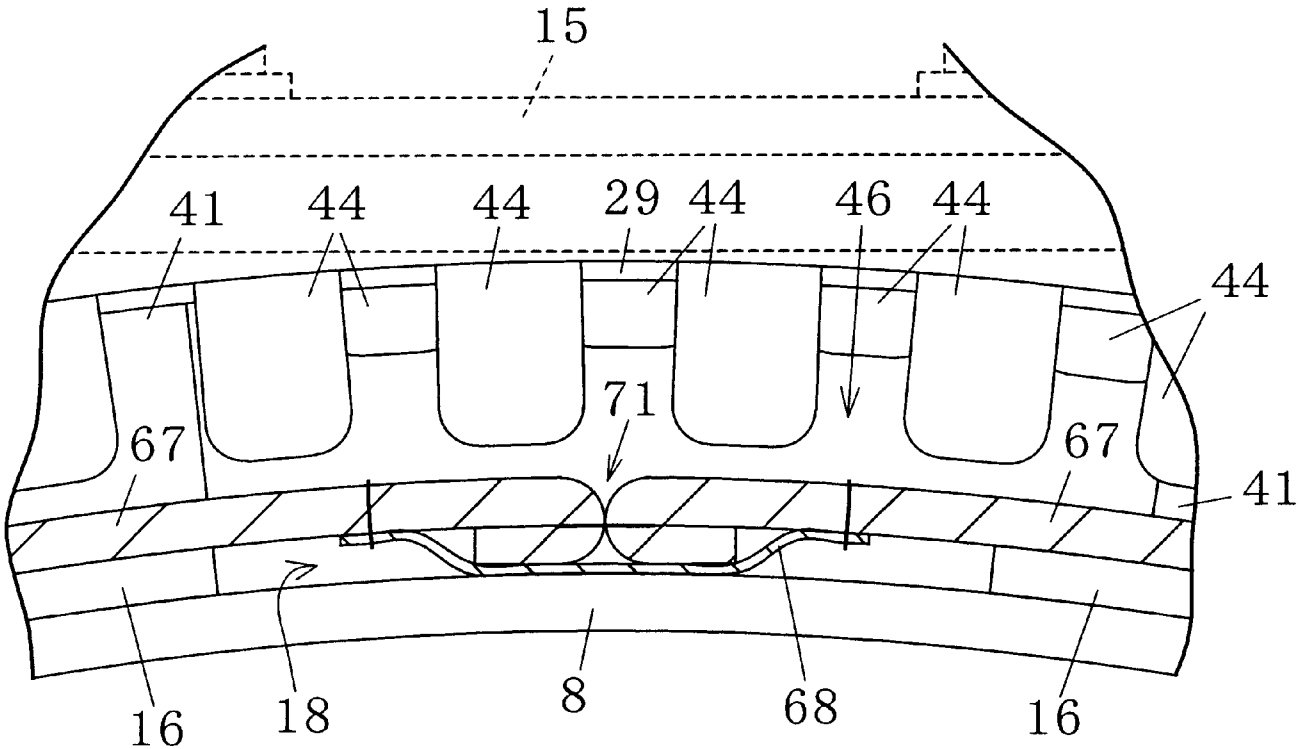
FIG. 10 is an enlarged view showing a portion of FIG. 9.

On the upper face of the second adjusting frame 8 and at the portion for receiving the top side peripheral portion 70*a* of the embroidery range 69, there are arranged generally in a row a pair of right and left non-slip members 16 and 16 which extend peripherally of the headgear. At portions for receiving the two side peripheral portions 70*c* and 70*c* of the embroidery range 69, there are arranged generally in parallel non-slip members 17 and 17 which individually extend in the headgear height direction. Here, a recess 18, as formed between the right and left non-slip members 16 and 16 extending in the headgear peripheral direction, releases an excess thickness over other portions in the embroidery range in a stitched portion 71, as shown in FIGS. 9 and 10. That recess 18 is formed by arranging not the non-slip portions 16 in the portion of the recess 18.

The first adjusting frame 7 and the second adjusting frame 8 are so mounted in slots 19 and 20 formed in the receiving frame body 6 and extended in the axial direction, by bolts 21 and nuts 22 as can be adjusted in axial positions. Upper faces of the receiving frame body 6, the first adjusting frame 7 and the second adjusting frame 8 form a cloth-covered face 23. In this cloth-covered face 23, there are formed a first aperture 24 and a second aperture 25, as shown in FIG. 3. The first aperture 24 is transversely extended in the peripheral direction of the receiving frame 2 by the edge portion of the receiving frame body 6 on the free end side of the receiving frame 2 and by the edge portion in the first adjusting frame 7 on the base end side of the receiving frame 2. In this first aperture 24, there are arranged (or released) the mesh portion 63 and the sweatband portion 64 which are extracted from the headgear 61. The second aperture 25 is formed by the edge portion of the mounting portion 6*a* of the receiving frame body 6, the edge portion of the first adjusting frame 7 on the free end side of the receiving frame 2 and the edge portion of the second adjusting frame 8 on the root end side of the receiving frame 2. The second aperture 25 is composed of a transversely elongated generally rectangular larger opening 25*a* formed to correspond to the embroidery range 69 and smaller openings 25*b* positioned to correspond to the root sides of the two side portions of a visor 66. These larger opening 25*a* and the smaller openings 25*b* communicate with each other. By adjusting the mounted positions of the first adjusting frame 7 and the second adjusting frame 8 with respect to the receiving frame body 6, moreover, the sizes of the first aperture 24 and the second aperture 25 (including the larger opening 25*a* and the smaller openings 25*b*) can be adjusted.

Here will be described the holding band 3. This holding band 3 is made of soft and thin metal sheet and is composed, as shown in FIGS. 4 and 5, of a band body 28, an adjusting band portion 29 and a pair of right and left holding plates 30 and 30. Moreover, the holding band 3 holds the upper and lower peripheral portions 70*a* and 70*b* in the headgear height direction of the embroidery range 69, and the right and left peripheral portions 70*c* and 70*c* in the headgear peripheral direction.

The band body 28 is equipped with a first band member 31 for holding the peripheral portion 70*b* of the embroidery range 69 on the visor side in the headgear peripheral direction, and connecting portions 36 and 37 formed integrally with and on the two end sides of the first band member 31 for holding the two side portions 76 of the cap portion 62. These two connecting portions 36 and 37 form a holding portion which holds the vicinities of the roots of the two side portions of the visor 66 and the cap portion 62 in those vicinities.

At the two end portions on the edge portion of the band body 28 on the visor side, there are provided a pair of right and left first positioning members 33 which protrude generally vertically with respect to the face confronting the upper face of the receiving frame 2. Here, "the visor side" means one side of the band body 28, which comes closer to or confronts the root of the visor 66 when the headgear 61 is hold by the holding band 3. These first positioning members 33 retain and position the open edge portions of the cap portion 62 in the vicinities of the roots of the two side portions of the visor 66. Between the two first positioning members 33 on the edge portion of the band body 28 on the visor side, there are provided a number of second positioning members 34 which individually protrude generally vertically with respect to the face confronting the upper face of the receiving frame 2. At the edge portion of the first band member 31 on the side opposed to the visor side, there are provided a number of holding members 35 which individually protrude generally vertically with respect to the face confronting the upper face of the receiving frame 2. The second positioning members 34 bite into a stitched portion 77 between the front portion 65 and the visor 66 of the headgear 61 thereby to position the first band member 31. The holding members 35 hold the peripheral portion 70*b* of the embroidery range 69 on the side of the visor over the headgear peripheral direction. The second positioning members 34 are formed to bite into the stitched portion 77 generally all over the peripheral portion 70*b* of the embroidery range 69 on the side of the headgear visor. The holding members 35 are set to have a larger protrusion than that of the second positioning members 34.

Although the sizes of the individual portions of the first band member 31 are not specifically limited: the second positioning members 34 have a protrusion of about 2 mm; the holding members 35 have a protrusion of about 4 mm; and the spacing between the second positioning members 33 and the holding members 35 is set to about 5 mm. Thus, the second positioning members 34 and the holding members 35 have a protrusion difference set to 2 mm.

One connecting portion 36 of the band body 28 is turnably hinged to the connecting rod 12, and the other connecting portion 37 is equipped with a retaining tool 38 to be removably retained on the retaining member 14 of the connecting rod 13. In these two connecting portions 36 and 37, there are individually formed a pair of slots 39 which are arranged in parallel at a spacing in the widthwise direction of the holding band 3 and extended in the longitudinal direction of the holding band 3.

The adjusting band portion 29 is provided with: a second band member 32 for holding the top side peripheral portion 70*a* of the embroidery range 69 over the headgear peripheral direction; a pair of non-slip members 41 attached at a spacing to a face of the second band member 32, which confronts the upper face of the receiving frame 2; and joint portions 42 and 42 individually formed integrally with the two end sides of the second band member 32. On the two edge portions extending in the longitudinal direction of the second band member 32, there are formed a number of pawls 44 which protrude generally vertically from the face confronting the upper face of the receiving frame 2. These pawls 44 position the non-slip member 41 so that the non-slip member 41 may not go out of position in the widthwise direction of the holding band 3. In the two joint portions 42, there are individually formed a pair of slots 45 which are formed in row at a widthwise spacing of the holding band 3 and extended widthwise of the holding band 3. Here, a recess 46, as formed between the paired non-slip members 41, is a second recess which is formed at a position, which corresponds to the recess 18, in the face, which confronts the upper face of the receiving frame 2, as shown in FIGS. 9 and 10.

The holding plate 30 is made of rectangular rigid metal sheets extending widthwise of the holding band 3 such that a non-slip member 47 is attached to the face confronting the upper face of the receiving frame 2 and such that a pair of bolt portions 48 are erected from the opposite face and at a widthwise spacing of the holding band 3.

The paired slots 39, as formed in the connecting portions 36 and 37 of the band body 28 and extended in the longitudinal direction of the holding band 3, and the paired slots 45, as formed in the joint portions 42 and 42 of the adjusting band portion 29 and extended in the widthwise direction of the holding band 3, are individually fastened by the paired bolt portions 48 erected on the holding plates 30 and by butterfly nuts 49. As a result, the relative positions of the connecting portions 36 and 37 and the joint portions 42 and 42 can be individually adjusted in the widthwise direction of the holding band and in the longitudinal direction of the holding band. As a result, the relative lengths between the second band member 32 on the top side and the first band member 31 on the visor side can be adjusted so that the length of the second band member 32 on the top side can be made smaller than that of the first band member 31 on the visor side. On the other hand, the relative spacing between the two band members 32 and 31 is made adjustable.

Here will be described how to use the headgear frame 1. First of all, the sweatband portion 64 and the mesh portion 63, as folded on the inner side of the cap portion 62, are extracted to the outer side of the cap portion 62, and the mesh portion 63 is folded back to envelop the sweatband portion 64 with its leading end side 63*a* so that the headgear 61 takes the state, as indicated by solid lines in FIG. 12.

In this state, the cap portion 62 is then brought from the free end side of the headgear frame 1 to cover the receiving frame 2. At this time, the embroidery range 69 of the front portion 65 of the cap portion 62 is positioned in the larger opening 25*a* of the second aperture 25. On the other hand, the margin to stitch of the cap portion 62, the margin to stitch of the mesh portion 63, the margin to stitch of the sweatband portion 64, the sweatband portion 64 and the mesh portion 63 are positioned in the first aperture 24.

Next, the holding band 3 is turned on the connecting rod to cover the front portion 65 of the cap portion 62, and the retaining tool 38 is connected to the retaining member 14 while eliminating the looseness of the cloth in the embroidery range 69. Then, the embroidery range 69 of the headgear 61 is tensed, as shown in FIGS. 6 to 10, such that its peripheral portion 70 is held on the upper face of the receiving frame 2 by the holding band 3.

At this time, when the holding band 3 does not correspond to the float of the stitched portion 77 from the upper face of the receiving frame 2, for example, and when the upper and lower peripheral portions 70*a* and 70*b* of the embroidery range 69 in the headgear height direction cannot be held in substantially equivalent strengths, the retaining tool 38 is removed from the retaining member 14, and the butterfly nuts 49 are loosened. Then, the relative lengths of the second band member 32 on the top side and the first band member 31 on the visor side are adjusted, and the retaining tool 38 is connected to the retaining member 14 again. By repeating these operations suitably, the holding band 3 is adjusted to hold the upper and lower peripheral portions 70*a* and 70*b* of the embroidery range 69 in the headgear height direction in substantially equivalent strengths. When the holding band 3 fails to correspond to the size of the embroidery range 69, on the other hand, the relative spacing between the second band member 32 and the first band member 31 is likewise adjusted.

In this state, as shown in FIGS. 7 and 8, not only the margin to stitch of the cap portion 62, the margin to stitch of the mesh portion 63 and the margin to stitch of the sweatband portion 64 but also the sweatband portion 64 and the mesh portion 63 are fitted in the first aperture 24. It is, therefore, possible to reduce the float of the embroidery range 69 from the receiving frame 2 on the visor side more than the prior art.

On the other hand, the holding band 3 holds not only the peripheral portion 70 but also the vicinities of the root sides of the two side portions of the visor 66 and the cap portion 62 in the vicinities by the connecting portions 36 and 37 so that two side portions of the visor 66 may come close to each other. At this time, the smaller openings 25*b* are formed in the upper face of the receiving frame 2 corresponding to the positions to be held by the connecting portions 36 and 37. As a result, the vicinities of the root portions of the two sides of the visor 66 and the cap portion 62 in the vicinities can be pushed into the smaller openings 25*b* thereby to bring the two side portions of the visor 66 closer to each other. If the two side portions of the visor 66 of the headgear are thus held closer to each other, the visor 66 is curved into an arcuate shape, as indicated by double-dotted lines in FIG. 11, so that it is inclined away from the embroidery range 69. As shown in FIGS. 6 to 8, therefore, the headgear 61 is so held on the headgear frame 1 that it is inclined away from the embroidery range 69.

According to the headgear frame 1 for the embroidering machine of the invention thus constructed, it is possible to achieve the following actions and effects.

(1) The first band member 31 is provided at its edge portion on the visor side with the second positioning members 34 to bite into the stitched portion 77 between the cap portion 62 and the visor 66, and at its edge portion on the side opposed to the visor side with the holding members 35 for holding the peripheral portion 70*b* of the embroidery range 69 on the visor side over the headgear peripheral direction. By the positioning members 34, therefore, the first band member 31 can be prevented from slipping from the stitched portion 77 to the side opposed to the visor side to prevent the embroidery range 69 from being narrowed, thereby to homogenize the embroidery quality of the headgear 61. At the same time, the cloth can be prevented from floating on the side of the visor 66 of the front portion 65 of the cap portion 62 to tense the embroidery range 69 in a flat state so that the flap of the cloth while being embroidered can be reduced to prevent the needle breakage or the pattern displacement.

Though the stitched portion 77 is caused to float from the cloth-covered face 23 by the stitched portions of the cap portion 62, the visor 66, the mesh portion 63 and the sweatband portion 64 on the inner side of the cap portion 62 and by the mesh portion 63 and the sweatband portion 64 extracted from the headgear 61, the holding members 35 have the longer protrusion than that of the second positioning members 34. Therefore, the peripheral portion 70*b* of the embroidery range 69 on the visor side can be pushed to a lower position than that of the stitched portion 77 floating from the cloth-covered face 23, thereby to reduce the float of the peripheral portion 70*b* on the visor side from the cloth-covered face 23

(2) The second band member 32 as the upper band member in the headgear height direction is made shorter than the first band member 31 as the other band member. Therefore, the peripheral portion 70*b* of the embroidery range on the lower side of the headgear height direction, as caused to float from the upper face of the receiving frame 2 by the overlaps of the margins to stitch of the cap portion 62, the visor 66, the mesh portion 63 and the sweatband portion 64, the mesh portion 63 and the folded-back sweatband portion 64, and the peripheral portion 70*a* of the embroidery range on the upper side of the headgear height direction, as left unfloating, can be held in the substantially equivalent strengths.

On the other hand, the relative lengths of the two band members 32 and 31 are made adjustable. According to the structure of the stitched portion 77 of the headgear 61 and the kind/thickness of the cloth of the individual portions composing the headgear 61, therefore, the two band members 32 and 31 can be adjusted to hold the upper and lower peripheral portions of the embroidery range in the headgear height direction in the substantially equivalent strengths.

On the other hand, the relative distance between the two band members is made adjustable so that the it can suitably match the various widths of the embroidery range 69 of the headgear 61.

(3) The receiving frame 2 is provided on its upper face with the recess 18 for releasing the excess thickness in the stitched portion 71 over the remaining portion within the embroidery range. Unlike the prior art, therefore, when the headgear 61 is mounted on the headgear frame 1, the stitched portion 71 does not rise over the remaining portions within the embroidery range, or the height of the rise itself can be reduced. Therefore, it is possible to improve the quality of the embroidery in the stitched portion 71 better than the prior art.

(4) The holding band 3 is constructed to hold not only the peripheral portion 70 but also the vicinities of the roots of the two side portions of the visor 66 in an approaching manner and the cap portion 62 in those vicinities. When the holding band 3 is attached to the receiving frame 2, therefore, the visor 66 is curved in the arcuate shape and is inclined in the direction apart from the embroidery range 69. Unlike the prior art, therefore, it is unnecessary to incline the visor forcibly. This makes it unnecessary to provide a device for inclining the visor 66 forcibly. It is also possible to omit the work to incline the visor 66 forcibly. This work can be omitted to eliminate the displacement of the headgear 61 out of position with respect to the headgear frame during the work and to make it unnecessary to mount the headgear 61 again.

On the other hand, the holding band 3 is equipped with the first positioning members for positioning the cap portion in the vicinities of the roots of the two side portions of the visor 66. Therefore, the connecting portions 36 and 37 as the holding portions for the holding band 3 can hold the vicinities of the roots of the two side portions of the visor 66 and the cap portion 62 in those vicinities reliably.

On the other hand, the receiving frame 2 is provided with the smaller openings 25*b* in the upper face, as located to correspond to the roots of the two sides of the visor 66. The vicinities of the roots of the two sides of the visor 66 and the cap portion 62 in the vicinities can be pushed into the smaller openings 25*b* so that the visor 66 can be held to have its two side portions closer to each other. Therefore, it is possible to enlarge the inclination of the visor 66 away from the embroidery range.

On the other hand, the receiving frame 2 is so constructed that the sizes of the smaller openings 25*b* can be adjusted. Therefore, the smaller openings 25*b* can be set to a suitable size according to the structure of the headgear 61 and the kind/thickness of the cloth of the headgear 61.

(5) In the receiving frame 2, there is formed the first aperture 24 acting as an opening for releasing the mesh portion 63 and the sweatband portion 64, as extracted from the cap portion 62 So that they may be removed from the embroidery range 69. Unlike the prior art, the visor side of the front portion 65 is not pushed up away from the upper face of the receiving frame 2 by the mesh portion 63 and the sweatband portion 64. Therefore, the headgear 61 is not attached to the headgear frame 1 with the visor side floating from the upper face of the receiving frame 2.

On the other hand, the size of the first aperture 24 as the opening is made adjustable so that the first aperture 24 can be set to a suitable size according to the structure of the headgear 61 and the kind/thickness of the cloth of the mesh portion 63 and the sweatband portion 64.

Here, the invention should not be limited to the embodiment thus far described but can be modified and embodied in the following manners without departing from the gist thereof.

(1) The second positioning members 34 can be formed to bite not into the stitched portion 77 substantially all over the peripheral portion 70*b* of the embroidery range 69 on the visor side but into the stitched portion 77 of the cap portion 62 on the front center side.

(2) It is possible to change such sizes of the individual portions of the first band member 31 suitably as are exemplified by the protrusion of the second positioning members 34, the protrusion of the holding members 35 or the spacing between the second positioning members 34 and the holding members 35.

(3) One of the paired slots 39 and 39 formed individually in the connecting portions 36 and 37 is so sized that the bolt portions 48 can be inserted thereinto without any positional displacement. By adjusting the fastening positions of the bolt portions 48 on the slot side, therefore, the relative lengths of the first band member 31 and the second band member 32 are adjusted.

(4) The headgear frame 1 of the invention is employed in a headgear having no visor.

(5) Instead of forming the recess 18 by arranging none of the non-slip members 16, a recess is formed in the upper face of the non-slip members 16.

(6) The second recess 46 is not formed.

(7) The shape, position or number of the recess 18 is suitably changed according to the structure of the stitched portion 71 of the headgear 61 or the thickness/kind, position or number of the cloths.

(8) Recesses are formed in place of the smaller openings 25*b* in the upper face of the receiving frame 2. Moreover, these recesses are made adjustable in their size (or width).

(9) The holding band 3 is constructed to hold not the roots of the two side portions of the visor of the headgear but the leading end side of the same.

(10) A recess is formed as the opening in place of the first aperture 24.

(11) The recess of (10) is made adjustable in size.

As many apparently widely different embodiments of this invention may be made without departing from the spirit and scope thereof, it is to be understood that the invention is not limited to the specific embodiments thereof except as defined in the appended claims.

What is claimed is:

1. A headgear frame for an embroidering machine, comprising: a receiving frame inserted into a cap portion of a headgear having a visor for receiving a peripheral portion of an embroidery range of said cap portion; and a holding band wound around said cap portion for holding said peripheral portion between itself and said receiving frame and including a band member for holding the peripheral portion of said embroidery range on the visor side over the headgear peripheral direction, wherein said band member is provided at its edge portion on the visor side with a positioning member for biting into a stitched portion between said cap portion and said visor, and at its edge portion on the side opposed to said visor side with a holding member for holding the peripheral portion of said embroidery range on the visor side over the headgear peripheral direction.

2. A headgear frame for an embroidering machine according to claim 1, wherein said positioning member is formed to bite into said stitched portion at least on the front central side of said cap portion.

3. A headgear frame for an embroidering machine according to claim 1, wherein said positioning member is so formed over the substantial entirety of the peripheral portion of said embroidery range on the visor side as to bite into said stitched portion.

4. A headgear frame for an embroidering machine according to claim 1, wherein said holding member has a larger protrusion than that of said positioning member.

5. A headgear frame for an embroidering machine, comprising: a receiving frame inserted into a cap portion of a headgear for receiving a peripheral portion of an embroidery range of said cap portion; and a holding band wound around said cap portion for holding said peripheral portion between itself and said receiving frame and including a pair of band members for holding the upper and lower peripheral portions of said embroidery range individually in the headgear height direction, wherein the upper band member in said headgear height direction is made shorter than the other band member.

6. A headgear frame for an embroidering machine according to claim 5, wherein the relative lengths of said two band members are made adjustable.

7. A headgear frame for an embroidering machine according to claim 5, wherein the relative spacing of said two band members is made adjustable.

8. A headgear frame for an embroidering machine, comprising:

a receiving frame inserted into a cap portion of a headgear having a thicker stitched portion in an embroidery range than the remaining portions for receiving the peripheral portion of the embroidery range of said cap portion; and a holding band wound around said cap portion for holding said peripheral portion between itself and said receiving frame, wherein said receiving frame is provided in its upper face with a recess for releasing the excess thickness in said stitched portion than the remaining portions, wherein said receiving frame is provided on its upper face with a non-slip member for preventing the cap portion from going out of position, and wherein said recess is formed by arranging not said non-slip member in the portion of said recess.

9. A headgear frame for an embroidering machine, comprising:

a receiving frame inserted into a cap portion of a headgear having a thicker stitched portion in an embroidery range than the remaining portions for receiving the peripheral portion of the embroidery range of said cap portion; and a holding band around said cap portion for holding said peripheral portion between itself and said receiving frame, wherein said receiving frame is provided in its upper face with a recess for releasing the excess thickness in said stitched portion than the remaining portions, wherein said receiving frame is provided on its upper face with a non-slip member for preventing the cap portion from going out of position, and wherein said recess is formed in the upper face of said non-slip member.

10. A headgear frame for an embroidering machine, comprising: a receiving frame inserted into a cap portion of a headgear having a visor for receiving a peripheral portion of an embroidery range of said cap portion; and a holding band wound around said cap portion for holding said peripheral portion between itself and said receiving frame, wherein said holding band holds said peripheral portion and either the two side portions of the visor of said headgear or the cap portion in the vicinity of the root sides of said two side portions so that said two side portions may come closer to each other.

11. A headgear frame for an embroidering machine according to claim 10, wherein said holding band is provided with a holding portion for holding either said two side portions or the cap portion in the vicinities of the root sides of said two side portions.

12. A headgear frame for an embroidering machine according to claim 11, wherein said holding band is provided with a positioning member for positioning either the vicinities of said root sides or the cap portion in the vicinities of said root sides.

13. A headgear frame for an embroidering machine according to claim 11, wherein said receiving frame is provided with a recess or an opening in the upper face at positions corresponding to the root sides of the two side portions of said visor.

14. A headgear frame for an embroidering machine according to claim 13, wherein said receiving frame is so constructed as to adjust the size of said recess or said opening.

15. A headgear frame for an embroidering machine adapted to be used for holding a headgear in which a mesh portion arranged on the back side of the front portion of a cap portion and a ring-shaped sweatband portion arranged on the inner side of said cap portion are stitched on the open edge portion of said cap portion, and comprising:

a receiving frame inserted into a cap portion of a headgear having a visor for receiving a peripheral portion of an embroidery range of said cap portion; and a holding band wound around said cap portion for holding said peripheral portion between itself and said receiving frame, wherein said receiving frame is provided with a recess or opening for releasing said mesh portion and said sweatband portion, as extracted from said cap portion so that they may be removed from said embroidery range, and wherein said recess or said opening is made adjustable in size.

* * * * *